United States Patent [19]

Herchenroeder et al.

[11] 4,012,229

[45] Mar. 15, 1977

[54] DUCTILE COBALT-BASE ALLOYS

[75] Inventors: Robert B. Herchenroeder; Coleman M. Augustine, Jr., both of Kokomo, Ind.

[73] Assignee: Cabot Corporation, Kokomo, Ind.

[22] Filed: Oct. 10, 1972

[21] Appl. No.: 295,992

[52] U.S. Cl. ..... 75/171; 148/32

[51] Int. Cl.[2] ..... C22C 19/07

[58] Field of Search ..... 75/171, 170; 148/32, 148/32.5

[56] References Cited

UNITED STATES PATENTS 3,366,478 1/1968 Wheaton ..... 75/171

OTHER PUBLICATIONS

*Rare Metals Handbook*, Second Edition, Edited by Clifford A. Hampel, Reinhold Publishing Corp., 1961, pp. 301 to 302.

*Primary Examiner*—R. Dean

*Attorney, Agent, or Firm*—Buell, Blenko & Ziesenheim

[57] ABSTRACT

A ductile cobalt-base alloy having high strength is provided having molybdenum in the range 1% to 8% molybdenum by weight.

3 Claims, No Drawings

DUCTILE COBALT-BASE ALLOYS

This invention relates to ductile cobalt-base alloys and particularly to improved high temperature ductility of high strength tantalum-containing cobalt-base superalloys achieved by controlled additions of molybdenum.

Cobalt-base alloys have long been used for high temperature applications; however, a major problem has been forming the alloys into desired shapes.

It is the purpose of this invention to provide cobalt-base alloys capable of developing intermediate temperature high strengths and having superior ductility at high temperatures often used for forging, rolling, and forming.

Molybdenum is usually considered as an element which provides solid solution strengthening in nickel and cobalt-base alloys. Further, molybdenum is expected to reduce high temperature ductility when added to an alloy — not markedly increases it. We have discovered that molybdenum within proper limitations will cause the 2000° F ductility of certain cobalt-base alloys to be markedly improved, for an example, from about 80 percent elongation to about 180 percent elongation, contrary to ordinary expectations.

Such an increase in ductility significantly improves the ability to hot forge, roll, form or otherwise mechanically work the alloy. Molybdenum and tungsten are often considered substitutions; in this invention, they are not.

A cobalt-base alloy in accordance with the present invention is an alloy consisting essentially in weight percent of about:

| | |
|---|---|
| Cr | 15–30 |
| Ni | 10–30 |
| Mo | –8 |
| W | 0–10 |
| Ta | 8–20 |
| Co | Balance plus incidental modifiers and impurities |

A preferred range of the invention is an alloy consisting essentially in weight percent of about:

| | |
|---|---|
| Cr | 18–27 |
| Ni | 15–28 |
| Mo | 1–8 |
| W | 0–8 |
| Ta | 8–20 |
| Co | Balance plus incidental impurities and modifiers |

A particularly preferred range of the invention is an alloy consisting essentially in weight percent of about:

| | |
|---|---|
| Cr | 18–25 |
| Ni | 18–25 |
| Mo | 2–6 |
| W | 0–6 |
| Ta | 8–20 |
| Co | Balance plus incidental modifiers and impurities |

In addition to the above specifically mentioned elements, other incidental modifiers may be present to achieve improved oxidation resistance, deoxidation, economic benefits, strength modification, or as adventitious elements. These included in weight percent: Mn,<2; Si,<1; La,<0.2; Y,<0.2; Al,<0.6; Zr,<1; Fe,<10; B,<0.03; C,<1; and Hf,<3.

Our invention is perhaps best understood by reference to specific examples of four alloys hereinafter described Chemical compositions in weight percent are tabulated in Table I as follows.

TABLE I

| | CHEMICAL ANALYSIS - WEIGHT PERCENT | | | | | | | | | | | |
|---|---|---|---|---|---|---|---|---|---|---|---|---|
| Alloy | Al | C | Co | Cr | Fe | La | Mn | Mo | Ni | Si | Ta | W |
| 7 | 0.38 | 0.12 | Bal.* | 21.07 | 1.86 | 0.04 | 0.67 | 0.33 | 23.60 | 0.40 | 16.74 | — |
| 8 | 0.40 | 0.12 | Bal.* | 20.72 | 1.75 | <0.02 | 0.61 | 2.27 | 22.60 | 0.36 | 16.28 | — |
| 9 | 0.37 | 0.12 | Bal.* | 20.81 | 1.36 | 0.05 | 0.53 | 0.42 | 23.50 | 0.27 | 10.53 | 4.50 |
| 10 | 0.45 | 0.12 | Bal.* | 20.07 | 1.38 | 0.04 | 0.54 | 4.04 | 22.40 | 0.25 | 10.14 | 4.39 |

*Cobalt plus incidental impurities
— No W added to melt

Each of the alloys of Table I was subject to stress rupture tests and the stress rupture properties are tabulated in Table II below.

TABLE II

| | STRESS-RUPTURE DATA | | | |
|---|---|---|---|---|
| Alloy | Test Temperature, ° F | Stress, Ksi | Life, Hours | Elongation Percent |
| 7 | 1500 | 25 | 27.6 | 12 |
| | 1500 | 25 | 28.5 | 29 |
| | 1700 | 13 | 9 | 32 |
| | 1700 | 13 | 15.7 | 14 |
| | 1900 | 4.5 | 10.5 | 27 |
| | 1900 | 4.5 | 11.3 | 23 |
| 8 | 1500 | 25 | 50.8 | 49 |
| | 1500 | 25 | 56.2 | 52 |
| | 1700 | 13 | 6.5 | 79 |
| | 1700 | 13 | 6.9 | 75 |
| | 1900 | 4.5 | 3.3 | 135 |
| | 1900 | 4.5 | 3.8 | 150 |
| 9 | 1900 | 4.5 | 25 | 12 |
| | 1900 | 4.5 | 17.9 | 9 |
| 10 | 1900 | 4.5 | 12.8 | 29 |
| | 1900 | 4.5 | 15.4 | 24 |

Tensile data were also determined for each of the alloys of Table I and the values are tabulated in Table III hereafter.

TABLE III

| | TENSILE DATA | | | |
|---|---|---|---|---|
| Alloy | Test Temperature, ° F | 0.2% Offset Yield Strength, Ksi | Ultimate Strength Ksi | Elongation Percent |
| 7 | 1600 | 73.4 | 103.2 | 8 |
| | 1600 | 72.2 | 99.2 | 13 |
| | 2000 | 4.3 | 15.0 | 94 |
| | 2000 | 4.8 | 16.4 | 71 |
| 8 | 1600 | 60.5 | 84.6 | 19 |
| | 1600 | 63.4 | 89.9 | 14 |
| | 2000 | 3.6 | 14.2 | 173 |
| | 2000 | 5.6 | 13.9 | 194 |
| 9 | 1600 | 63.1 | 81.8 | 10 |
| | 1600 | 70.9 | 86.9 | 12 |

TABLE III-continued

| Alloy | Test Temperature, ° F | TENSILE DATA 0.2% Offset Yield Strength, Ksi | Ultimate Strength Ksi | Elongation Percent |
|---|---|---|---|---|
| | 2000 | 11.6 | 18.4 | 40 |
| | 2000 | 7.2 | 18.7 | 40 |
| | 1600 | 71.5 | 87.2 | 11 |
| | 1600 | 66.0 | 88.6 | 11 |
| | 2000 | 11.6 | 17.5 | 65 |
| | 2000 | 10.3 | 17.7 | 61 |

The four alloys of Table I were melted by conventional vacuum-induction techniques, although any nuber of melting techniques may have been used. Approximately 100-pound charges of Alloys 7 and 9 were melted and about one-half of each of the two heats were cast into nominally 20-pound ingots and chemical samples. Thereafter, late additions of molybdenum were made to the balance of the heats to yield the chemical analysis shown in Table I for Alloys 8 and 10.

Forging and hot rolling was done after preheating to 2150° F. The material was annealed at 2175 ± 25° F and rapidly cooled. Tensile and stress-rupture specimens conformed to ASTM recommendations that the gage length be four times the specimen width.

Examination of the data of Tables I, II, and III shows conclusively that molybdenum markedly improved the high temperature ductility of alloys 8 and 10 as compared to the respective reference Alloys 7 and 9. This is in direct contradiction of prior teaching that molybdenum is a high temperature strengthener and hardener which characteristics generally cause a loss of ductility. It is also surprising to note the excellent intermediate temperature tensile strength of the alloys of this invention as shown in Table III.

While we have illustrated and described certain preferred embodiments of our invention in the foregoing specification, it will be understood that this invention may be otherwise embodied within the scope of the following claims.

We claim:

1. A cobalt-base alloy characterized by improved ductility at high temperatures of about 2000° F. and consisting essentially of about 15 to 30% chromium, about 10 to 30% nickel, an effective amount from about 1 to 8% molybdenum to impart ductility, up to about 10% tungsten, about 8 to 20% tantalum and the balance cobalt with incidental modifiers and impurities in ordinary amounts.

2. An alloy as claimed in claim 1 consisting essentially of about 18–27% chromium, about 15–28% nickel, about 1 to 8% molybdenum, up to about 8% tungsten, about 8 to 20% tantalum and the balance cobalt with incidental modifiers and impurities in ordinary amounts.

3. An alloy as claimed in claim 1 consisting essentially of about:

| | |
|---|---|
| Cr | 18–25 |
| Ni | 18–25 |
| Mo | 2–6 |
| W | 0–6 |
| Ta | 8–20 |
| Co | Balance plus incidental modifiers and impurities |

* * * * *

UNITED STATES PATENT AND TRADEMARK OFFICE

CERTIFICATE OF CORRECTION

PATENT NO. : 4,012,229

DATED : March 15, 1977

INVENTOR(S) : ROBERT B. HERCHENROEDER and COLEMAN AUGUSTINE, JR.

It is certified that error appears in the above–identified patent and that said Letters Patent are hereby corrected as shown below:

Column 1, line 50, the alloy "Mo" should read with a weight percent of "1-8".

Column 2, line 19, after "described" insert a period (.).

Column 3, line 14, "nuber" should read --number--.

Signed and Sealed this

*Eighteenth* Day of *April 1978*

[SEAL]

*Attest:*

RUTH C. MASON
*Attesting Officer*

LUTRELLE F. PARKER
*Acting Commissioner of Patents and Trademarks*